US005894641A

United States Patent [19]

Hurtz et al.

[11] Patent Number: 5,894,641

[45] Date of Patent: Apr. 20, 1999

[54] SNAP FASTENER CLOSURE

[75] Inventors: Winfried Hurtz, Stolberg; Michael Schwarz, Herne, both of Germany

[73] Assignee: William Prym GmbH & Co. KG, Stolberg, Germany

[21] Appl. No.: 08/930,526

[22] PCT Filed: Apr. 24, 1996

[86] PCT No.: PCT/EP96/01701

§ 371 Date: Oct. 2, 1997

§ 102(e) Date: Oct. 2, 1997

[87] PCT Pub. No.: WO96/35344

PCT Pub. Date: Nov. 14, 1996

[30] Foreign Application Priority Data

May 10, 1995 [DE] Germany ..... 195 17 010
Mar. 21, 1996 [DE] Germany ..... 196 11 123

[51] Int. Cl.[6] ..... A44B 17/00

[52] U.S. Cl. ..... 24/658; 24/633

[58] Field of Search ..... 24/652, 658, 655, 24/656, 657, 633

[56] References Cited

U.S. PATENT DOCUMENTS 1,735,620 11/1929 Salley .
5,084,947 2/1992 Evans et al. ..... 24/658
5,451,082 9/1995 Murai ..... 24/658 X

FOREIGN PATENT DOCUMENTS 0127996 12/1984 European Pat. Off. .
343131 10/1921 Germany .
442833 8/1966 Switzerland .

*Primary Examiner*—James R. Brittain
*Attorney, Agent, or Firm*—Friedrich Kueffner

[57] ABSTRACT

The object of a snap fastener closure is to couple a male part with a female part (20) as easily as possible, but so that it is difficult to uncouple them. The female part (20) comprises a push plate (30) which is movable longitudinally in a housing (23) and forks into two plate legs in the interior of the housing. The two plate legs are formed of two portions (31, 32) which are profiled differently with respect to the closing head (12) of the male part, one of these portions (31) serving to lock and the other portion (32) serving to release the closing head (12). In order to achieve easy coupling, it is proposed that the portion (31) acting to lock is provided at the free ends of the two plate legs so that they can spread apart elastically. Then, by inserting the closing head (12) of the male part, an automatic coupling in is made possible between the two plate legs. This portion (31) thus becomes the coupling portion. One plate leg is provided with a bent lengthening (36) which acts as a spring on the push plate (30) and, by its coupling portion (31), holds the push plate (30) in alignment with an entrance hole for the closing head (12) in the housing (23).

13 Claims, 3 Drawing Sheets

FIG. 1a
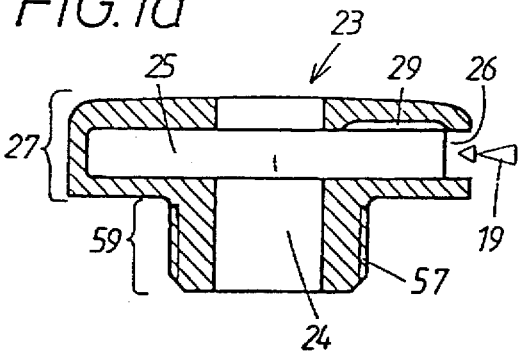
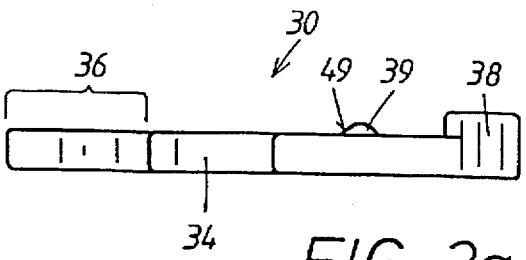
FIG. 2a
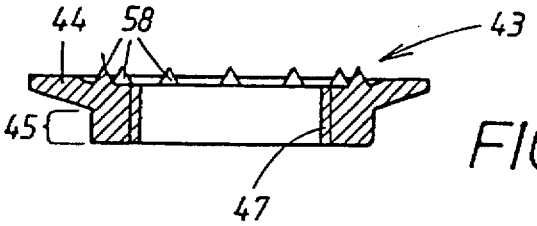
FIG. 3a
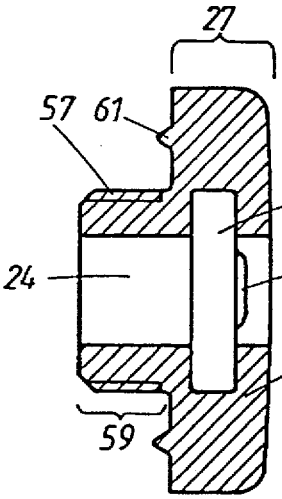
FIG. 1c
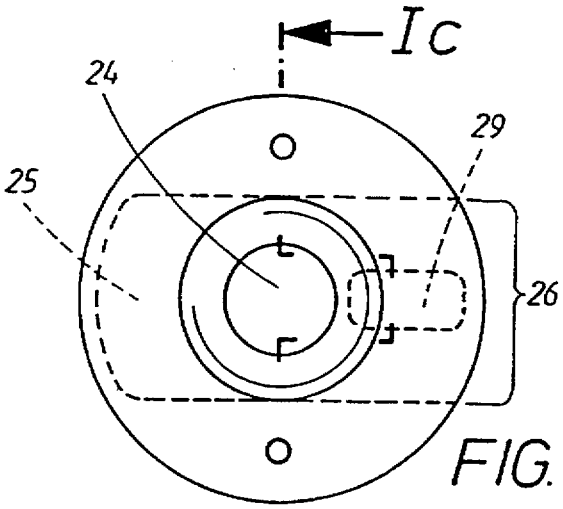
FIG. 1b
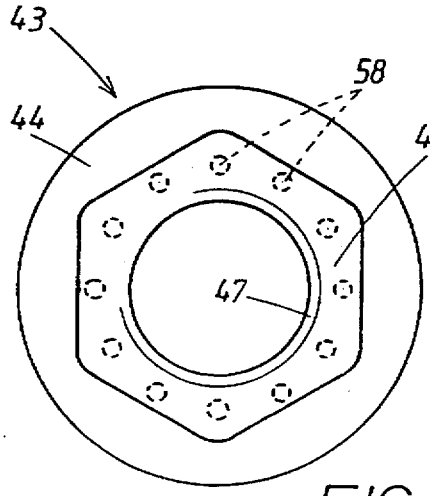
FIG. 3b
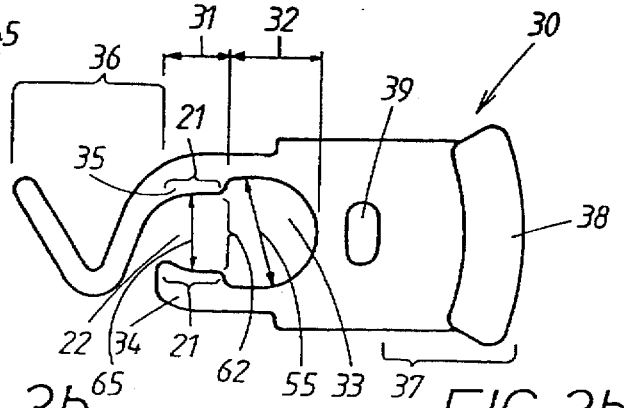
FIG. 2b

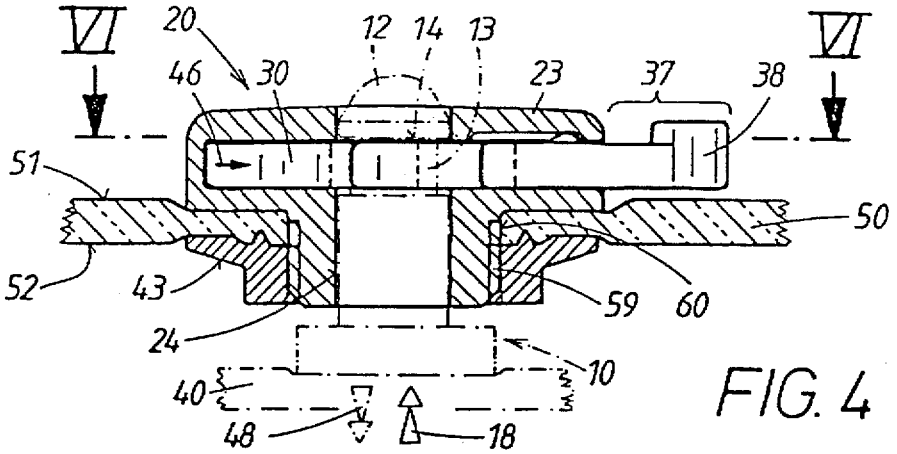
FIG. 4
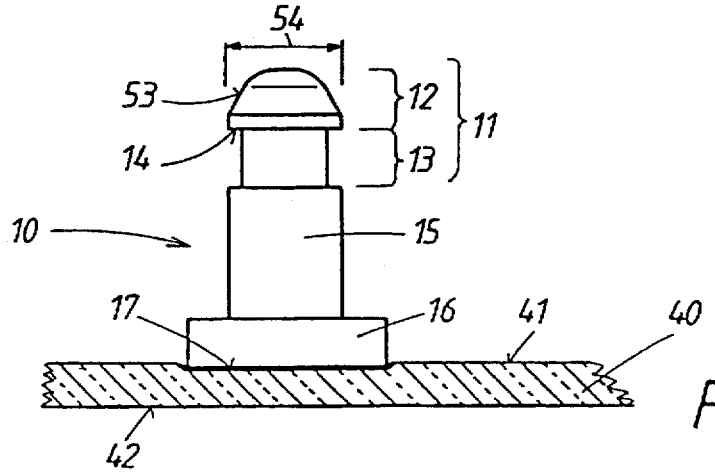
FIG. 5
FIG. 6a
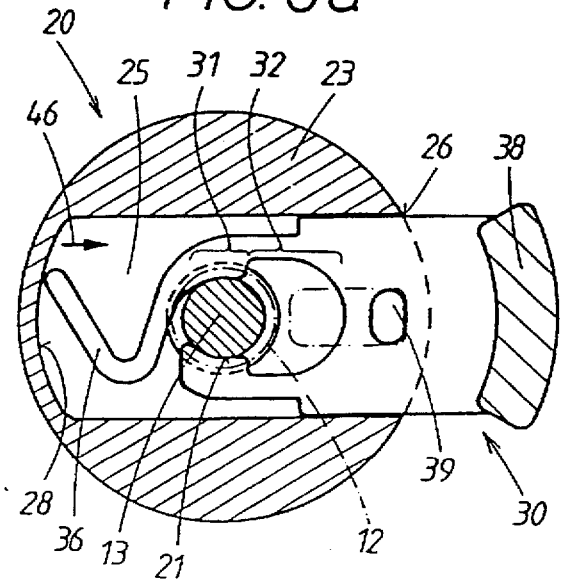
FIG. 6b
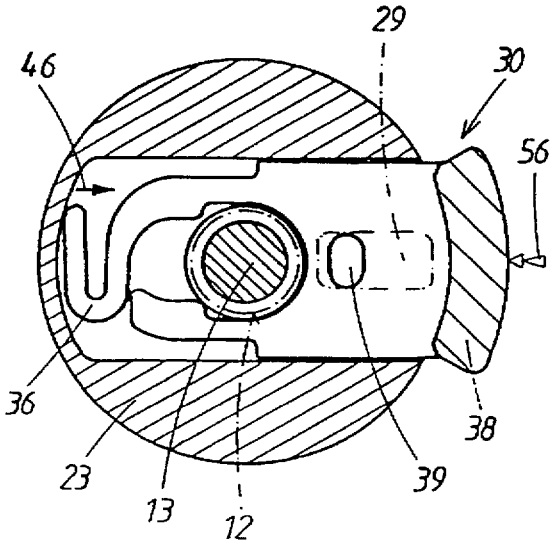

SNAP FASTENER CLOSURE

FIELD OF THE INVENTION

The present invention relates in general to an attachment system, and more particularly to a snap fastener closure.

BACKGROUND OF THE INVENTION

A snap fastener closure is a type of attachment system that has a multiple-part socket part or female part with a housing for the male part, which housing has an insertion hole. A push plate made of resilient or elastic material is arranged in this housing. This push plate is forked and is guided by its two plate legs into a shared channel of the housing. The plate legs are divided into portions which differ from one another in extent, and the plate legs have a lock portion where the plate leg is smaller than a closing head of the male part. This characterizes the lock portion of the push plate. However, this lock portion also allows an elastic expanding or spreading movement and is therefore also a coupling portion to enable the closing head of the male part to be inserted through the insertion hole in the housing. The push plate is acted upon by a spring and can be pushed in until there is a large distance between the plate legs at the insertion hole and makes it possible for the male part to be pulled out axially.

In the known snap fastener closure of this kind (CH 442 833 A), the two plate legs have the same length and are supported by their ends at the two sides of an angled projection in the housing. When the push plate is pressed into the housing, the two leg ends slide at the sides of the angle which are inclined relative to one another in a mirror-inverted manner and the two plate legs spread apart in the lock portion until the closing head of the coupled in male part, behind which closing head the plate legs engage, can be removed from the housing of the female part. The two plate legs are connected in the transition to the shared actuating end by a circular arc which increases the overall width of the push plate and improves the spreading elasticity of the leg ends. This widened transition limits the pushing out of the push plate and requires a correspondingly widened channel in the housing.

Because the overall width of the push plate is not uniform, a multiple-part housing is required. Therefore, in order to produce the female part, an expensive individual production of two housing parts and a complicated, time-consuming assembly is required. Although the distance between the two plate legs in the arc-shaped transition is widened, this region cannot be made use of for uncoupling the male part because, when pressing in, the push plate is moved axially to such a limited extent that the male part still remains in the effective lock portion for coupling. In this snap fastener closure, the spreading elasticity used between the two plate legs is the same as that which, together with the angular projection, generates the push-out force. The plate legs are accordingly under a constant force acting in the spread-out direction, which force can lead to material fatigue over the course of time. However, reduced elasticity threatens the dependability of the engagement of the male part in the female part.

OBJECT AND SUMMARY OF THE INVENTION

The object of the present invention is to develop a snap fastener closure which can be produced more economically and which is distinguished by reliable locking.

In the invention, one plate leg is lengthened and bent into itself at an angle. This plate lengthening forms the longitudinally elastic spring which provides for a push-out force of the push plate. Consequently, when the slide is pushed in, the distance between the two plate legs does not change; rather, only the lengthened plate leg is deformed. The channel walls in the housing of the female part can guide the push plate and, unlike the prior art, do not require any lateral widening. It is therefore possible for the housing channel to be constructed simply with parallel walls because the entire housing can then be constructed in one piece from castable or extrudable material such as plastic. A multiple-part housing known in the prior art is dispensed with in an economical manner as is also, consequently, an expensive individual manufacture and complicated assembly of a plurality of housing parts. The female part of the snap fastener closure according to the invention thus has only two parts, namely, a one-piece housing and a two-legged push plate.

Further steps and advantages of the invention are indicated in the subclaims, the following description, and the drawings. The drawings show the invention in two embodiment examples.

BRIEF DESCRIPTION OF THE DRAWINGS

FIG. 1*a* shows a longitudinal section through the housing of the female part according to the invention;

FIG. 1*b* shows a top view of the housing shown in FIG. 1*a;*

FIG. 1*c* shows a cross section through the housing of FIG. 1*b* along section line Ic—Ic extending therein;

FIGS. 2*a* and 2*b* show a side view and a top view of a further structural component part to be introduced in the housing shown in FIG. 1*a*, namely, a slide;

FIGS. 3*a* and 3*b*, similar to FIGS. 1*a* and 1*b*, show a longitudinal section and a top view, respectively, of a counter-holder associated with the housing of the female part;

FIG. 4 shows a longitudinal section corresponding to FIGS. 1*a* and 3*a* through the mutual fastening of these two structural component parts at a carrier after the slide shown in FIG. 2*a* has already been mounted in the housing of FIG. 1*a;*

FIG. 5 shows a side view of a complementary male part associated with the female part of FIG. 4;

FIGS. 6*a* and 6*b* shows horizontal sections through the female part along section line VI—VI of FIG. 4, but with the male part of FIG. 5 inserted in the housing of the female part, this male part also being shown in section specifically, in a coupling position in FIG. 6*a* and, in FIG. 6*b*, in a release position allowing the male part to be uncoupled;

DETAILED DESCRIPTION OF THE INVENTIION

Figure 7A:
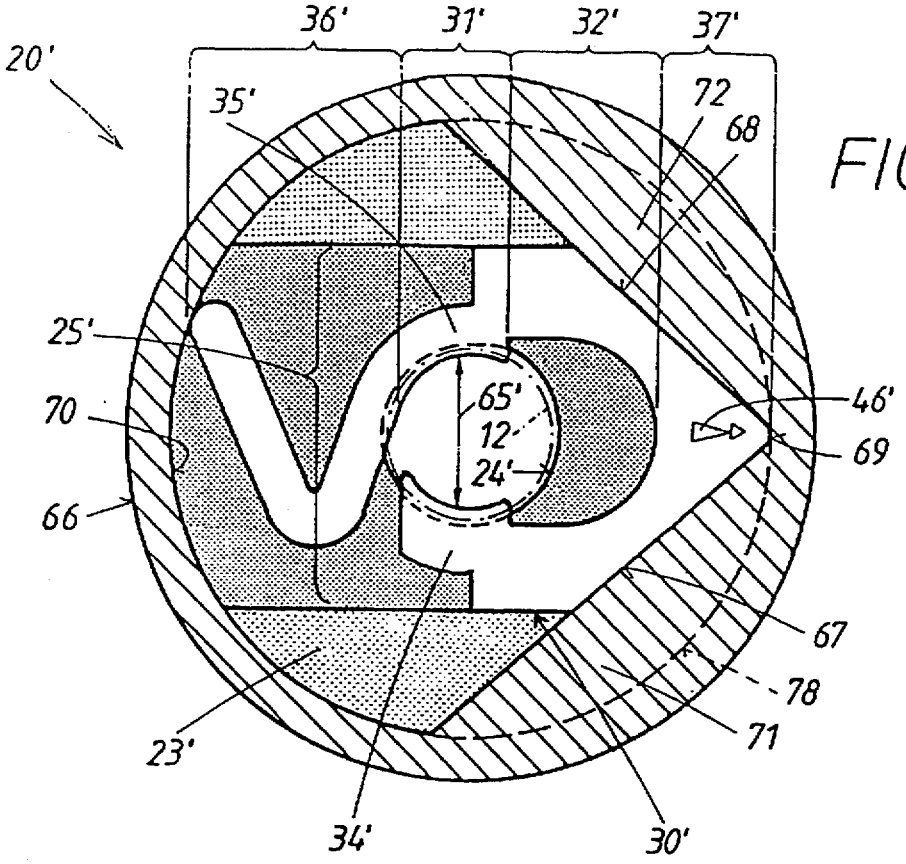
FIG. 7*a* is a schematic, greatly enlarged view of a horizontal section through an alternative construction of the female part, where the coupling position of the push plate is shown analogous to FIG. 6*a;*

As can be seen from FIGS. 4 and 5, the snap fastener closure according to the invention has a female part 20 which is fastened to a first carrier 50 and a male part 10 which is located on a second carrier 40. The two snap fastener parts 10, 20 serve to hold the two carriers 40, 50 together or to detach them from one another, as desired. For this purpose, the two snap fastener parts 10, 20 have complementary male-type and female-type coupling surfaces 11, 21.

As can be seen in FIG. 5, the coupling surfaces 11 of the male part 10 are divided into a closing head 12 and a closing neck 13 which is offset in cross section relative to the closing head 12. The coupling surfaces 11 are situated above a shaft 15, in the present case at an end flange 16 which serves for the fastening of the male part 10 to its carrier 40. In the present embodiment example, the fastening is effected by means of a weld connection 17 of the underside of the flange with the upper side 41 of the carrier 40. Naturally, any other fastening measures can also be used to arrange the male part 10 at the carrier 40, e.g., rivets which are set proceeding from the underside 42 of the carrier 40 and engage at the flange 16, for example. Grooved nails can also be used, these grooved nails being anchored in the interior of the male part, e.g., in the region of an axial bore hole provided in the shaft 15.

As can be seen from the detailed drawings in FIGS. 1*a* to 2*b*, the female part 20 is formed of two component parts 23, 30, namely, a housing 23 and a slide 30 which is movable longitudinally therein. Although the housing 23 could have two housing halves which are mountable one upon the other, it is more advantageous to construct the housing 23 in one piece as is shown in the embodiment example in FIGS. 1*a* and 1*b*. The housing 23 is fastened to the visible side 51 of the carrier. In the present instance, this is effected by an additional structural component part, namely, the counter-holder 43 shown in FIGS. 3*a* and 3*b* which is fashioned in the manner of a nut. of course, any other fastening method, known per se, could also be used to arrange the female part 20 at the carrier 50.

First, the housing 23 has an insertion hole 24 in the form of an axial bore hole in which the male-type coupling surfaces 11 of the male part 10 are inserted in the direction indicated by insertion arrow 18 shown in FIG. 4 for the purpose of coupling. This insertion hole 24 traverses a channel 25 which is arranged in the interior of the housing and which serves to guide the slide 30. The guide channel 25 opens out in a slit 26 at a side surface 27 of the housing that determines the extent of the housing. After it is mounted, the slide 30 projects out of this slit by an end piece 37 as will be seen from FIG. 4, a widened handle 38 being located at this end piece 37. The assembly of the two structural component parts 23, 30 is carried out in the manner described hereinafter.

As can be seen from FIGS. 2*a*, 2*b*, the slide 30 is shaped like a plate; but a projection 39 and, for the sake of an improved grip, the handle 38, as well, project upward on one side of the plate plane. Associated with this projection 39 is a connecting link or slotted link 29 at an inner surface of the guide channel 25, which slotted link 29 serves to guide the push plate 30 after the latter is mounted. Assembly is effected in a simple manner in that the part of the push plate 30 located forward of the end piece 37, which part will be described more fully, is inserted through the side slit 26 in the mounting direction indicated by the arrow 19 shown in FIG. 2*a*. Since the push plate 30 is formed in the present case from a material which is elastic with respect to its shape, such as plastic, the projection 39 and the slotted link 29 cooperate in the manner of a snap-in connection. More specifically, the projection 39 has a run-up slope 49 shown in FIG. 2*a* which snaps through the slit 26 by means of elastic deformation of the projection 39 itself and/or of the housing wall and locks in the slotted link 29. In case it is desired to disassemble the push plate 30 from the housing 23, its projection 39 can have an inclined surface, shown in FIG. 2*a*, which is located opposite to the run-up slope 49 and which allows the push plate 30 to be pulled out of the channel 25 in the direction opposite to the assembly direction 19.

As can be seen from FIG. 2*b*, the push plate 30 forks toward its end into two plate legs 34, 35. At their edges which face one another, these plate legs 34, 35 are provided with a determined profile which divides them into two portions 31, 32. After the push plate 30 has been mounted, which can be seen most clearly from FIG. 6*a*, the push plate 30 is influenced by a spring 36 which tends to hold it in the initial position shown in the Figure and which will be referred to hereinafter for the sake of brevity as the "coupling position" for reasons to be explained hereinafter. More particularly, the spring 36 generates a spring force which is indicated by arrow 46 in FIGS. 4 and 6*a*. In this respect, the projection 39 of the push plate 30 strikes the outer end of its slotted link guide 29 which functions for this purpose as an end stop.

The female-type coupling surfaces 21 of the female part 20 which correspond to the male part 10 are arranged in the portion 31 of the push plate 30 which will therefore be referred to hereinafter as the "coupling portion" for the sake of brevity. This coupling portion 31 has the actual female-type closing opening 22 which is produced by the profiled inner edges 21 of the two plate legs 34, 35. There is a small clearance 65 between the two leg edges 21 as shown in FIG. 2*b*. One plate leg 35 is lengthened and this lengthening simultaneously forms the above-described spring 36. The spring 36 is thus formed in one piece with the slide 30 and makes use of the elastic characteristics of the material, such as plastic, which is used to produce it. The spring 36 comprises a V-shaped angled portion situated in the plate plane. For assembly purposes, as shown in FIG. 6*a*, the free end of this V-spring 36 is supported in the simplest case at the inner surface 28 formed by the base of the channel itself.

In the coupling position of the slide 30 according to FIG. 4 and FIG. 6*a*, the female-type coupling surfaces 21 which are formed by the slide 30 and between which there is enclosed a small clearance 65, as indicated above, are axially aligned with the insertion hole 24 of the housing 23. When the male part 10 is inserted in the direction of the above-mentioned insertion arrow 18 shown in FIG. 4, the inclined surfaces 53 of the closing head 12 shown in FIG. 5 which are provided at the free end strike against the female-type coupling surfaces 21 and cause the two plate legs 34, 35 forming them to be spread apart in a springing-resilient manner. In this way, the entire closing head 12 which is widened relative to the clear width of the closing opening 22 can pass through. The transition location between the closing head 12 and the adjoining closing neck 13 in the male part 10 is provided with a sharp undercut 14 as is shown in FIG. 5. When the coupling position indicated in dash-dot lines as shown in FIG. 4 is reached, the closing opening 22 shown in FIG. 2*b* snaps around the closing neck 13 of the male part 10, which closing neck 13 is indicated in dash-dot lines in FIG. 4, so that the undercut 14 engages at the upper side of the push plate 30. The two plate legs 34, 35 engage around the closing neck 13 in the manner of pliers. The closing head 12 has an outer diameter 54, shown in FIG. 5, which is greater than the clear width of the closing opening 22 when the plate legs 34, 35 in the slide 30 are not spread apart. Consequently, in the coupling position of the push plate 30, the male part 10 cannot be uncoupled in the opposite direction to the insertion direction indicated by the above-mentioned arrow 18 in the direction indicated by the arrow 48 which is also shown in FIG. 4. For this purpose, the push plate 30 must first be moved into its position shown in FIG. 6*b* which will be referred to hereinafter for the sake of brevity as the "uncoupling position" for reasons which will be indicated in the following.

For the uncoupling position shown in FIG. 6*b*, the push plate 30 is pressed into the housing 23 in the movement direction indicated by arrow 56 by means of a handle 38, namely, against the action of the spring force 46 mentioned above. The spring 36 is accordingly deformed in a corresponding manner. The above-mentioned projection 39 located at the push plate 30 comes to a stop at the inner end of its slotted link 29 on the housing side. In this uncoupling position, the slide 30 is aligned axially by the adjacent portion 32, shown in FIG. 2*b*, with the insertion hole 24 on the housing side. Located in this portion 32 is a release opening 33 whose opening clearance 55 is constructed so as to be greater than or at least equal to the aforementioned cross section 54, shown in FIG. 5, of the closing head 12 of the male part 10. This portion 32 is therefore referred to as the "release portion". This widened release opening 33 is formed by a correspondingly widened profiling of the two plate legs 34, 35 described above. Between the closing opening 22 located at the latter and the release opening 33 on the other side is a passage 62 through which the closing neck 13 of the male part 10 moves during the pressing-in movement 56 of the push plate 30 until reaching the position shown in FIG. 6*b*. In this position, the male part 10, which is inserted as shown in FIG. 4, can be freely pulled out of the female part 20 in the direction indicated by arrow 48 without a special expenditure of force as is indicated by the dash-dot line in FIG. 6*b*. This is why the position shown in FIG. 6*b* can be referred to as the "uncoupling position" of the push plate 30.

In order to secure the coupling position of the slide 30 shown in FIG. 6*a*, there could be a resilient narrowing in the region of the passage 62, shown in FIG. 2*b*, relative to the diameter of the closing neck 13, which resilient narrowing is overcome in the course of the pressing-in movement 56 of the slide 30 into the uncoupling position shown in FIG. 6*b*. An elastic deformation of this type can be brought about in such a narrowing of the passage 62 by means of a resilient spreading of the two plate legs 34, 35.

As was already mentioned at the beginning, the fastening of the female part 20 at the carrier 50 is effected by means of a counter-holder 43 shown in FIGS. 3*a* and 3*b*. The counter-holder 43 is an annular body which is divided in the axial direction into a plate 44 with numerous pointed, axial projections 58 and a noncircular portion in the shape of a hexagon tang 45 which can be acted upon by a tool. The counter-holder 43 is provided axially with an internal thread 47 in the manner of a nut.

The housing 23 of the female part 20 has an axial shoulder 59 which is provided with an external thread 57 and which can be screwed together with the nut thread 47 of the counter-holder 43 for fastening purposes. In this connection, a hole 60 is first punched in at the location of the carrier 50 that is to be provided with the female part 20 as is shown in FIG. 4, the threaded shoulder 59 of the female part 20 being inserted through this hole 60. In so doing, the housing 23 comes to rest with its undersurface at the visible side 51 of the carrier 50. The counter-holder 43 is screwed on from the back side 52 of the carrier, wherein its pointed projections 58 penetrate into the material of the carrier 50. As is illustrated in FIG. 1*c*, the undersurface of the housing 23 can also be provided with corresponding pointed teeth 61 which penetrate into the carrier material in an analogous manner proceeding from the visible side 51 of the carrier for fastening purposes. The pointed projections 58 and/or teeth 61 are intended to secure the counter-holder 43 in its screwed on position on the threaded shoulder 59 of the female-type housing 23.

Figure 7B:
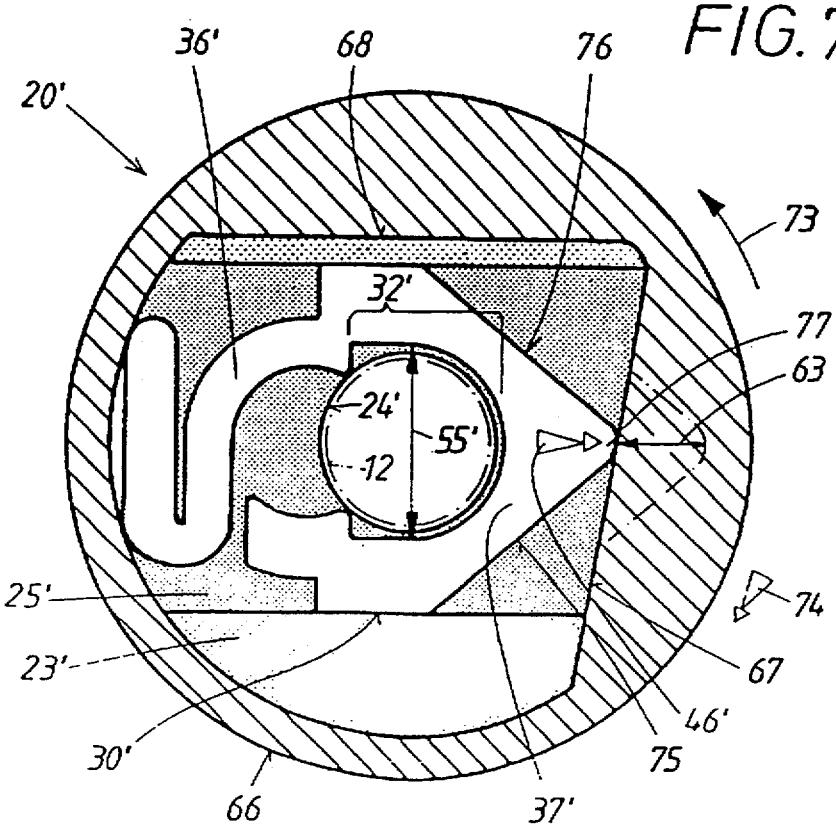
FIG. 7*b* shows the same horizontal section as that in FIG. 7*a* but, as in FIG. 6*b*, with the push plate in its release position which allows the male part to be uncoupled.

FIGS. 7*a* and 7*b* show an alternative construction 20' of the female part. The corresponding male part is constructed in a manner similar to that shown in FIG. 5 and has a closing head 12 whose outline is indicated in dash-dot lines in FIGS. 7*a* and 7*b*. The female part 20' has a construction substantially analogous to that of the preceding embodiment example 20 of the female part. The female part 20' comprises a housing 23' which is emphasized by different stippling. The regions of the housing 23' with the lighter stipple are higher than those with the darker stipple.

The housing 23' has a circular housing circumference 78, illustrated by short dashes in FIG. 1, at which an annularly shaped rotating handle 66 is supported so as to be rotatable. The housing 23' has an insertion hole 24' for the male part, for which reason it is greater in diameter than the above-mentioned closing head 12 of the male part. This insertion hole 24' penetrates the guide channel 25' which is also provided in this case and which passes diametrically through the housing 23' and serves to receive a push plate 30' which is modified compared with the first embodiment example.

This push plate 30' is also forked adjoining its actuating end 37' such that two plate legs 34', 35' are formed. These plate legs 34', 35' are similarly profiled and can be divided into the lock portion 31' and the release portion 32'. One plate leg 35' is lengthened and, in this case as well, forms a spring 36' which is located at an inner surface 70 of the rotating handle 66 at the location where the rotating handle 66 closes the guide channel 25'. Thus, this push plate 30' is also under the influence of a push-out force 46'. The two plate legs 34', 35' enclose between them, by portions 31', 32', respectively, a large clearance 55' and a small clearance 65'.

The rotating handle 66 has an inner profile 67 to 69 which faces the push plate 30' and which, in the present case, is constructed in the shape of an arrowhead and describes two edges 67, 68 which converge in a tip 69. This inner profile 67 to 69 thus has a concave shape. Associated with this inner profile 67 to 69 is an outer profile 75 to 77 at the actuating end 37' of the push plate 30. In the present case, this outer profile 75 to 77 has a convex shape which complements the above-mentioned concave shape of the rotating handle 66 and which is likewise shaped like an arrowhead, namely, likewise two edges 75, 76 which converge to a form a arrowhead 77. The two tips 69, 77 are advisably rounded.

In the present case, the edges 67, 68 and 75, 76, respectively, are formed in a straight line, but could also have a diverging curvature. The outer profile 75 to 77 of the push plate 30' could be arranged in a different vertical plane compared to FIGS. 7*a*, 7*b*, where the rotating handle also has its corresponding inner profile 67 to 69. It is not necessary to give both profiles 67 to 69 and 75 to 77 the same shape; the profiles could also be different. In the present case, the outer profile 75 to 77 is formed by the outer edges which lie in the plate plane and define the push plate 30' in the pushing-out direction 46'.

The rotating handle 66 could be supported at separate axial regions of the housing 23'. The rotating handle 66 could be formed of a ring segment. In the present case, however, as was already mentioned at the beginning, it is formed of a complete ring which encloses the housing 23' on all sides in a circumferential area 21. However, at certain locations, the rotating handle 66 has ring segments 71, 72, between which are generated the above-described inner profile 67 to 69. The rotating handle 66 projects into the guide channel 25' of the housing 23' by these ring segments 71, 72 at least in some areas. Accordingly, the channel opening of the guide channel 25' is also closed in those areas. The push plate 30' is always pressed with its outer profile 75 to 77 against the profile regions of the rotating handle 66 by the push-out force 46'. The push plate 30' is accordingly located in a longitudinal position determined by the rotational position of the rotating handle 66. This is shown in FIGS. 7*a* and 7*b*.

FIG. 7*a* shows the initial position of the rotating handle 66 which is characterized in that the push plate 30' has planar contact along the inner profile 67 to 69 of the rotating handle 66 by its outer profile 75 to 77 in a positive engagement. Thus, in cooperation with the spring force 46', the push plate 30' has a defined longitudinal position in the guide channel 25'. The coupling portion 31' is axially aligned with the housing insertion hole 24'.

By turning the rotating handle 66 in the direction of arrow 73 in FIG. 7*b*, the associated inner profile 67 to 69 is also naturally turned with reference to the outer profile 75 to 77 of the push plate 30'. In so doing, as is shown in FIG. 7*b*, the arrowhead 77 moves from the slide actuation end 37' to the segment edge 67 of the rotating handle 66 and is displaced by a partial distance 63 shown in FIG. 7*b*. The push plate 30' is thus pushed inward against its spring force 46' and the leg elongation 36' acting as a spring is accordingly flattened. The release portion 32' is now aligned with the insertion hole 24' of the housing 23' in a manner similar to FIG. 6*b*. The release position of the push plate 30' is in effect.

The rotational position shown in FIG. 7*b* can be defined by inner end stops. These end stops can be formed by regions of the push plate 30', for example, or from parts in the interior of the housing 23'.

In the rotational position shown in FIG. 7*b*, in which the inner profile edge 67 is still in an inclined position relative to the effective direction of the push-out force 46', there occurs a force component derived from this push-out force 46' which exerts a restoring torque, indicated by arrow 74 in FIG. 7*b*, on the rotating handle 66. If the rotating handle 66 is released by the hand of the user in the rotating position shown in FIG. 7*b*, the rotating handle 66 will automatically turn back 74. The rotating handle 66 is turned back until the initial position shown in FIG. 7*a* is reached. In this initial position, the push plate 30' is in its maximum moved out position. There is full planar contact between the inner profiles 67 to 69 and outer profiles 75 to 77; the two arrowheads 69, 77 are aligned with one another. The torque 74 which, until then, acts on the rotating handle 66 has disappeared. Consequently, the push plate 30' is in a secured initial position.

Of course, the push-out force 46' acting on the push plate 30' could also be generated by a separate spring which is not, as it is in the present case, constructed in one piece with the push plate 30'. The construction of the rotating handle 66 could have any desired shape and could be arranged, for example, on the visible side of the housing 23' of the female part 20'. In this case, a diametrical rib could be provided at the rotating handle for sensing by the hand.

We claim:

1. A snap fastener closure comprising:

a male part having a closing head and a closing neck, said closing head and said closing neck defining a male-type coupling surface;

a female part comprising a one-piece housing having a surface defining an insertion hole for engagement with said male-type coupling surface and through which said male part may be inserted, said one-piece housing further comprising an inner surface defining a shared channel;

said female part further comprising an elastic push plate which is guided transversely in relation to said insertion hole, an actuating end, and two plate legs, said two plate legs adjoining at said actuating end and configured to be guided in said shared channel, said two plate legs having portions at different distances from each other;

said push plate having a locking portion wherein inner leg ends of said plate legs are arranged so as to define a small clear width which is narrowed relative to said male part and between which said male part may be inserted and locked;

said push plate configured so that a push-out force is generated by said plate legs in order to cause said push plate to move relative to said housing and said locking portion to be aligned with said insertion hole of said housing, said movement caused by said push-out force limited by an end stop, said locking portion configured to be spread apart elastically so as to produce an elastic coupling portion for engagement with said closing head of said male part when inserted in said female part;

said push plate further having a release portion wherein said push plate is further configured to be displaced into an unlocking position when pressed by means of said actuating end, such that, in said unlocking position, said two plate legs define a large distance relative to said male part, said large distance enabling said male part to be pulled out of said female part axially;

said push plate being further configured such that a leg end of one said plate leg is lengthened and has a bend such that said lengthened plate leg is bent in upon itself relative to said other plate leg, said lengthened plate leg being supported in an interior region of said housing, said bend of said lengthened plate leg being deformable so as to form a longitudinally elastic spring which generates said push-out force, such that in the course of pushing said push plate into said one-piece housing with a push-in force, said lengthened plate leg is compressed until said release portion is arranged at said insertion hole such that said large distance between said plate legs provides a large clear width which exceeds said closing head and enables said male part to be pulled out axially.

2. The snap fastener closure according to claim 1, wherein said end stop of said push plate further comprises a projection disposed on a plate end piece, said plate end piece located at said actuating end of said push plate, and wherein said inner surface of said one-piece housing is configured so as to define a slotted link, said projection engaging said slotted link so as to secure said push plate in said locking position and in said unlocking position.

3. The snap fastener closure according to claim 2, wherein said projection and said slotted link have run-up slopes for securing said push plate in said housing channel.

4. The snap fastener closure according to claim 1, wherein an actuation of said push plate is effected by means of a rotating handle which is supported at said housing of said female part, said rotating handle having an inner profile which faces said actuating end of said push plate, said actuating end of said push plate having an outer profile, said outer profile and said inner profile in engagement with each other such that said spring action of said lengthened leg causes said inner profile to press against said outer profile, said inner and outer profiles forming end stops that limit a maximum distance said push plate can be pushed out.

5. The snap fastener closure according to claim 4, wherein said inner and outer profiles engage so as to form additional end stops that limit a maximum distance said push plate can be pushed in.

6. The snap fastener closure according to claim 4, wherein said outer profile is formed by an outer edge that limits said push plate and that faces in a pushing out direction of said push plate.

7. The snap fastener closure according to claim 4, wherein said inner profile of said rotating handle is formed at least in part so as to define a straight line.

8. The snap fastener closure according to claim 4, wherein said inner profile of said rotating handle is constructed in the shape of an arrowhead and is formed of two edges that converge to a tip to define a concave shape, and wherein said outer profile of said push plate defines a convex shape of an arrowhead that corresponds to said concave shape of said inner profile.

9. The snap fastener closure according to claim 4, wherein said inner profile of said rotating handle encloses a guide channel of said housing.

10. The snap fastener closure according to claim 4, wherein said rotating handle has an annular shape, said annular shape enclosing said housing of said female part in a circumferential zone, said rotating handle having ring segments, said ring segments comprising said inner profile that engages said push plate and said ring segments projecting into a slit of said housing, said slit arranged in a region of said channel receiving said push plate.

11. The snap fastener closure according to claim 4, wherein said rotating handle has a maximal rotational angle limited by inner stops, said maximum rotating angle corresponding to said unlocking position of said push plate, said inner stops formed by regions of said inner profile.

12. The snap fastener closure according to claim 4, wherein said rotating handle has a maximal rotational angle limited by inner stops, said maximum rotating angle corresponding to said unlocking position of said push plate, said inner stops formed by said inner edges of said housing.

13. The snap fastener closure according to claim 4, wherein said spring force, exerted by said push plate when said rotating handle is rotated, further exerts a restoring torque on said rotating handle so as to automatically restore said rotating handle to an initial unrotated position.

* * * * *